US007083080B2

(12) United States Patent
McKenzie

(10) Patent No.: US 7,083,080 B2
(45) Date of Patent: Aug. 1, 2006

(54) MAIL DELIVERY INDICATOR ASSEMBLY

(76) Inventor: Dean A. McKenzie, 52393 Maple St., Marcellus, MI (US) 49067

( * ) Notice: Subject to any disclaimer, the term of this patent is extended or adjusted under 35 U.S.C. 154(b) by 0 days.

(21) Appl. No.: 11/198,551

(22) Filed: Aug. 5, 2005

(65) Prior Publication Data

US 2005/0269392 A1 Dec. 8, 2005

Related U.S. Application Data

(63) Continuation-in-part of application No. 10/764,468, filed on Jan. 27, 2004, now abandoned.

(60) Provisional application No. 60/511,656, filed on Oct. 17, 2003.

(51) Int. Cl.
*A47G 29/12* (2006.01)

(52) U.S. Cl. ..... 232/35

(58) Field of Classification Search ..... 232/35; D99/29–32, 43; 116/215
See application file for complete search history.

(56) References Cited

U.S. PATENT DOCUMENTS 3,426,966 A * 2/1969 Lay ..... 232/35
D260,319 S * 8/1981 Kuntz, Jr. ..... D99/29
4,821,953 A * 4/1989 Poloha ..... 232/35
D335,747 S * 5/1993 Dearing et al. ..... D99/29
D341,917 S * 11/1993 Meher ..... D99/29
5,284,295 A * 2/1994 Steinfeldt ..... 232/35
D356,428 S * 3/1995 Piatkowski et al. ..... D99/43
D447,313 S * 8/2001 Murawski et al. ..... D99/43
2005/0082358 A1* 4/2005 McKenzie ..... 232/35

* cited by examiner

*Primary Examiner*—William L. Miller
(74) *Attorney, Agent, or Firm*—Miller Johnson

(57) ABSTRACT

A mail delivery indicator assembly (100) for a mailbox (102) with a door (105) includes a signal holder bracket (101) attached to a mailbox door (105). A signal ball (108) is attached by a tether (110) to the signal holder bracket (101) for indicating when the mailbox door is opened. The signal holder bracket (101) attaches within a holder receptacle (109) attached to the mailbox door (105) which allows the signal holder bracket (101) to be removed. The signal holder bracket (101) may further include an offset section (103) for allowing the bracket to be attached to a recessed door. Additionally, the signal holder bracket may include one or more guards (112, 114) which prevent snow other debris from inadvertently removing the signal ball (108) from the ring section (107).

14 Claims, 3 Drawing Sheets

MAIL DELIVERY INDICATOR ASSEMBLY

CROSS-REFERENCE TO RELATED APPLICATIONS

This application is a continuation-in-part of U.S. Ser. No. 10/764,468 entitled Mail Delivery Indicator, filed Jan. 27, 2004, now abandoned, which is a non-provisional patent application and claims the benefit of U.S. Provisional Patent Application Ser. No. 60/511,656, filed Oct. 17, 2003.

BACKGROUND OF THE INVENTION

1. Field of the Invention

The present invention generally relates to an apparatus that indicates when mail has been delivered to a mailbox and more particularly to a mailbox delivery indicator assembly that can be viewed from both the back and the front of the mailbox.

2. Description of the Related Art

Mailbox indicators that indicate when mail has been deposited in a mailbox are well known in the related art. These mail indicators can range in complexity from being very simple to those that require complicated electronics. Some of the simpler mail indicators are also reflected in the related art.

U.S. Patent Application Publication No. 2001/0000108 written by Perry and published on Apr. 5, 2001, outlines the use of a mail delivery signal kit, which includes a magnet, which can be mounted on the side or face of a mailbox door. There is also a tethering device which is anchored to a portion of the mailbox, a stopper constructed of a metallic material which will connect to the magnet and which can be attached to one end of the tether and a visual indicator device which can be retained on the tethering device, which is adapted to be stopped by the stopper attached to the tethering device.

U.S. Pat. No. Des. 260,319 issued to Kuntz, Jr. on Aug. 18, 1981, outlines the use of an ornamental design for a mailbox signal.

U.S. Pat. No. Des. 356,426 issued to Piatkowski at al. on Mar. 14, 1995, outlines the use of an ornamental design for a mailbox signal.

U.S. Pat. No. Des. 457,706 issued to Teichelman on May 21, 2002, outlines the ornamental design for a device for attachment to a mailbox for use in indicating the delivery of mail.

U.S. Pat. No. 2,609,787 issued to Lawson on Sep. 9, 1952, outlines the use of a dual signaling device to assist in mail collection and delivering activities, which are of great benefit to the owner of a mailbox in assuring himself that the mail carrier has been to the mailbox to either pick up mail or to deliver incoming mail, as the case may be.

U.S. Pat. No. 2,707,075 issued to Van Duzer on Apr. 26, 1955, outlines the use of a novel signal member for a mailbox which will automatically move to a clear signaling position visible to the eye both from the front and rear of the mailbox upon the opening of the mailbox door by the mail carrier when he or she deposits mail therein.

U.S. Pat. No. 2,815,167 issued to Bailes et al. on Dec. 3, 1957, outlines the use of a rural mailbox involving a door-actuated signal for indicating a deposit of mail in the mailbox by a mailman.

U.S. Pat. No. 3,426,966 issued to Lay on Feb. 11, 1969, outlines the use of a trough-like member that is structurally integral with the door of a rural mailbox which has its mouth directed upwardly when the door is closed to normally retain an elongated, cylindrical body secured to the mailbox by an elongated transversely flexible member. When the mailbox door is opened by a mail carrier, the support member mouth will be tilted downwardly to allow the body to gravitate from the support and to dangle from the transversely flexible member to provide visual indication that the mailbox door has been opened.

U.S. Pat. No. 3,547,070 issued to Schuh on Dec. 15, 1970, outlines the use of a signal attachment for a mailbox having a hinged door with a signal plate attached to one end of a chain, the other end of which is attached to an external mounting of the mailbox. The signal plate is adapted to be manually set in an inconspicuous position and frictionally held between the flange of the door and a sidewall portion of the mailbox.

U.S. Pat. No. 4,138,055 issued to Sherrill on Feb. 6, 1979, outlines the use of a signal device in the form of a coil type spring with an elongated end thereon for fitting under the lip of the door of a rural-type mailbox when the door is in a closed position. Intermediate to the end of the elongated portion is an enlarged portion preferably in the form of a ball to increase the visibility of the device.

U.S. Pat. No. 4,821,953 issued to Poloha on Apr. 19, 1989 outlines the use of a mailbox signaling apparatus for use on both rural-type and residential-type mailboxes. The apparatus includes a suspension unit having a support arm and at least one elongated slot and a signal unit including a signal member attached to the suspension unit, which is provided with an attachment ring that is dimensioned to be selectively received over the support arm and within the slot.

U.S. Pat. No. 5,284,295 issued to Steinfeldt on Feb. 8, 1994, outlines the use of a mailbox delivery signal device with a signal ball of aerodynamic configuration tethered to a support bracket mounted to the door of the mailbox. The support bracket includes a planar support member, which extends perpendicularly to the mailbox door and includes a circular hole having a diameter smaller than the diameter of the signal ball.

U.S. Pat. No. 6,053,404 issued to Jefferson et al. on Apr. 25, 2000, outlines the use of an automatic signaling device to be used with a standard rural mailbox to indicate that the door has been opened when a mail carrier puts mail in the mailbox. The primary components of the device have a signal flag, including a helical spring and a signal plate for attaching to the top end of the spring, a mounting bracket for mounting the helical spring to the door of the mailbox add a retaining bracket attached to the mailbox top.

Great Britain Patent Application No. 2,340,678 granted to Sherrill on Sep. 3, 1960, outlines the use of a signal device in the form of a coil-type spring with an elongated end thereon for fitting under the lip of the door of a rural type mailbox when the door is in the closed position. Intermediate to the end of the elongated portion is an enlarged portion preferably in the form of a ball to increase the visibility of the device. The end of the coil spring opposite the elongated portion has a provision for securing the same to the side of the standard rural type mailbox.

Although this prior art may outline the use of novel and useful devices, what is needed is a removable mailbox delivery indicator that can be observed from the front and the back of a mailbox. Such a mailbox delivery indicator should be versatile and easy to attach to an existing mailbox structure.

SUMMARY OF THE INVENTION

The invention is a mail delivery indicator assembly that is attached to a mailbox door. When attached to the mailbox, the mail delivery indicator is preferably in view from a user's home or establishment and indicates whether the mailbox door has been opened. The mail delivery indicator includes a signal holder bracket that is attached to the lower corner of the mailbox door where a signal ball is used to indicate when the mailbox door is opened. These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
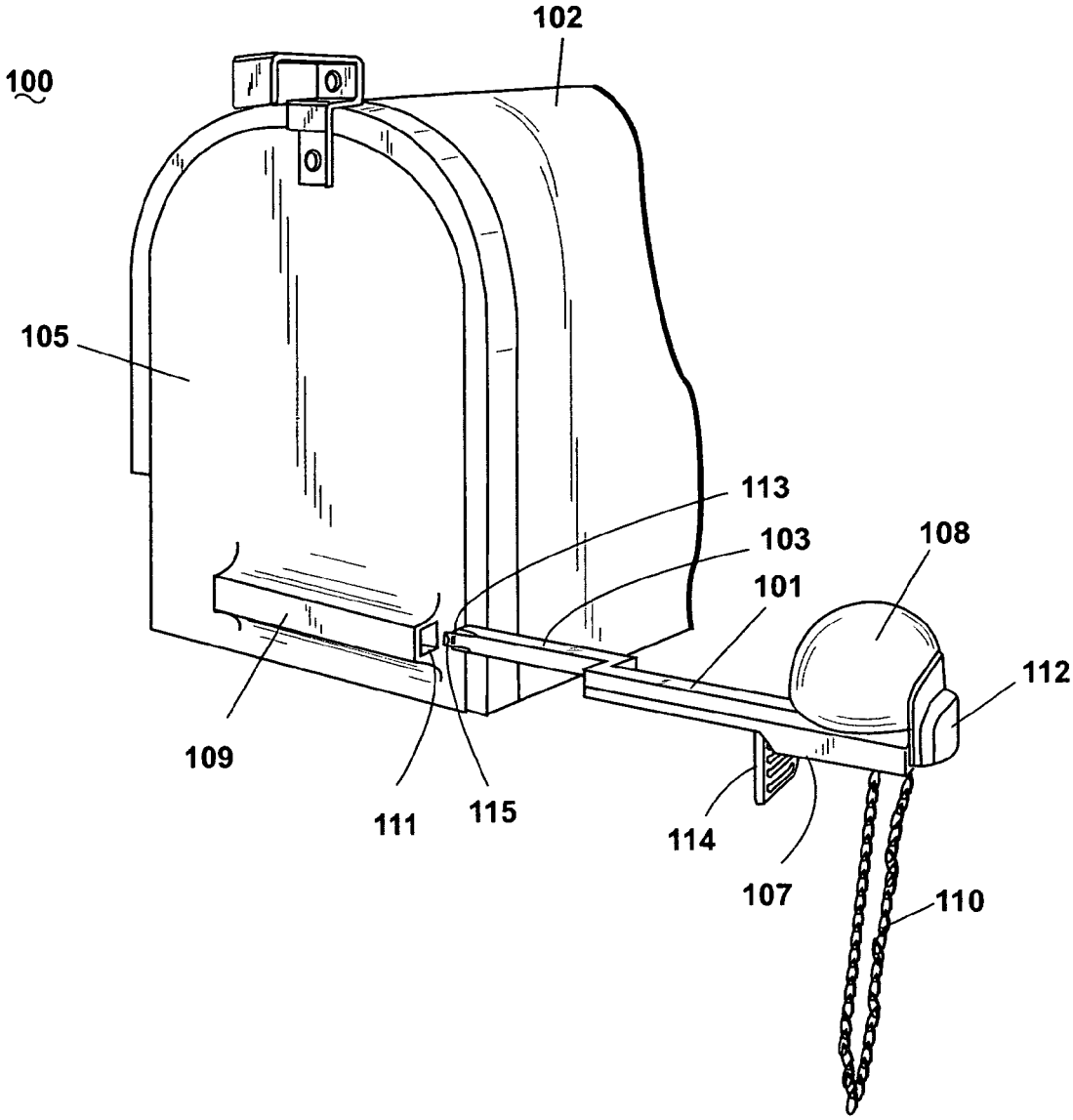
FIG. 1 is a side perspective view of the mail delivery indicator assembly for a mailbox for viewing at the side of the mailbox in accordance with the invention.

FIG. 1 illustrates a mail delivery indicator assembly 100 for use with a mailbox 102. The mail delivery indicator assembly 100 includes a signal holder bracket 101 having an offset section 103 for fastening the signal holder bracket to a mailbox door 105 which may either be flush or recessed into the opening of the box. The offset section 103 provides an angular displacement of the signal holder bracket 101 allowing one end to be fastened to a mailbox door which is recessed into the mailbox. As with previous embodiments, the signal holder bracket 101 further includes a ring section 107 that operates to hold a signal ball 108. A tether line 110 is attached to both the signal ball 108 and the signal holder bracket 101 so as to prevent the signal ball 108 from being lost when hanging outside the ring section 107. The ring section 107 further includes a first guard 112 and second guard 114 that work to block objects such as snow that may be propelled by a snow plow and/or other debris from inadvertently forcing the signal ball 108 from the ring section 107. Those skilled in the art will recognize that the signal ball 108 should only be removed from the ring section 107 when intended and any inadvertent or unintentional removal will provide the user with a false signal that the door has been opened.

The signal holder bracket 101 is attached to the mailbox door 105 through the use of a holder receptacle 109. The receptacle 109 may be molded into the mailbox door 105 during manufacture or may be fastened separately to a preexisting door. The receptacle 109 includes an engagement slot 111 that is a cavity within the receptacle 109 that works to accept an open end 113 of the signal holder bracket 101. When inserted into the receptacle 109 the signal holder bracket 101 can be firmly held into position. Thus in this embodiment, the signal holder bracket 101 is not fixedly attached to the mailbox door 105 allowing it to be easily removed for cleaning, maintenance or other purposes.

Figure 2:
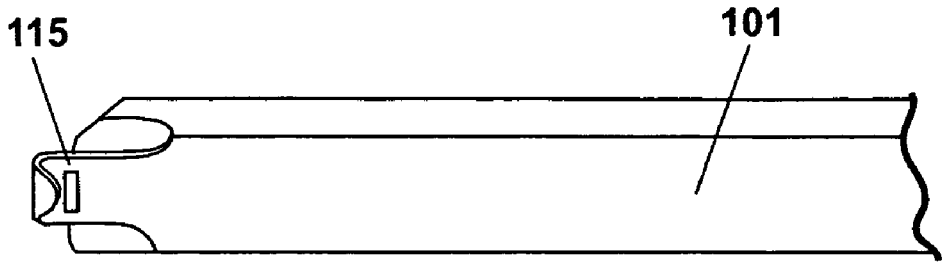
FIG. 2 is a side perspective view of a portion of the mail signal holder bracket.
Figure 3:
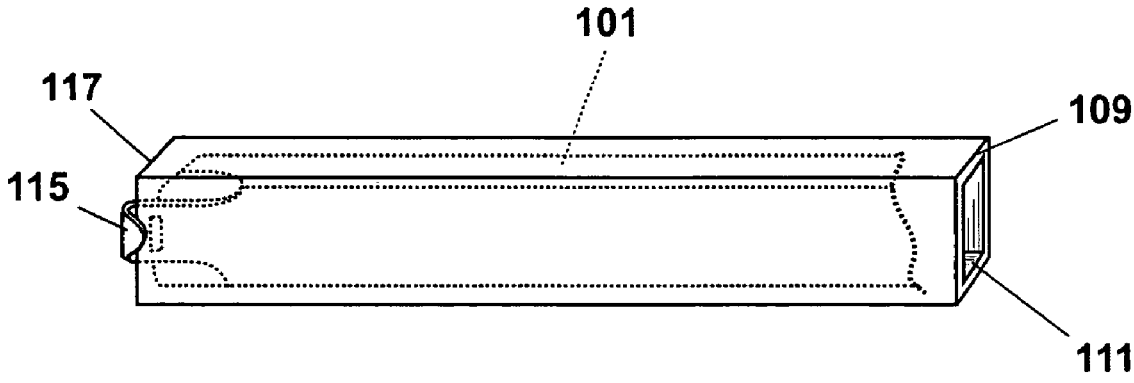
FIG. 3 is a side perspective view of the signal holder bracket inserted into a receptacle attached to the mailbox door.

FIGS. 2 and 3 illustrate closer views of the receptacle 109 as used with the signal holder bracket 101. As seen in FIG. 2, the signal holder bracket 101 further includes a fastener 115 that provides a resilient biasing force to hold the signal holder bracket 101 into the receptacle 109. As will be evident to those skilled in the art, the fastener 115 may be molded into the signal holder bracket 101 and operates such that when the signal holder bracket 101 is inserted into the receptacle 109, the fastener is compressed. As seen in FIG. 3, when the signal holder bracket 101 is fully inserted into the receptacle 109, the fastener 115 provides a biasing force by engaging and/or latching with the back end 117 of the receptacle 109. When the fastener 115 is fully inserted within the receptacle 109, the biasing force moves the fastener 115 allowing it to engage with edge of the receptacle 109. This allows the signal holder bracket 101 to be held into a rigid position despite any application of longitudinal force that would allow the signal holder bracket 101 to be pulled from the receptacle 109. To unlatch and remove the signal holder bracket 101, the fastener 115 may be compressed by squeezing the fastener 115 so that it disengages from the back end 117 so that it may be retracted from the receptacle 109. In an optional embodiment, the fastener 115 may be engaged within a locking hole (not shown) so as to securely hold it into position.

Figure 4:
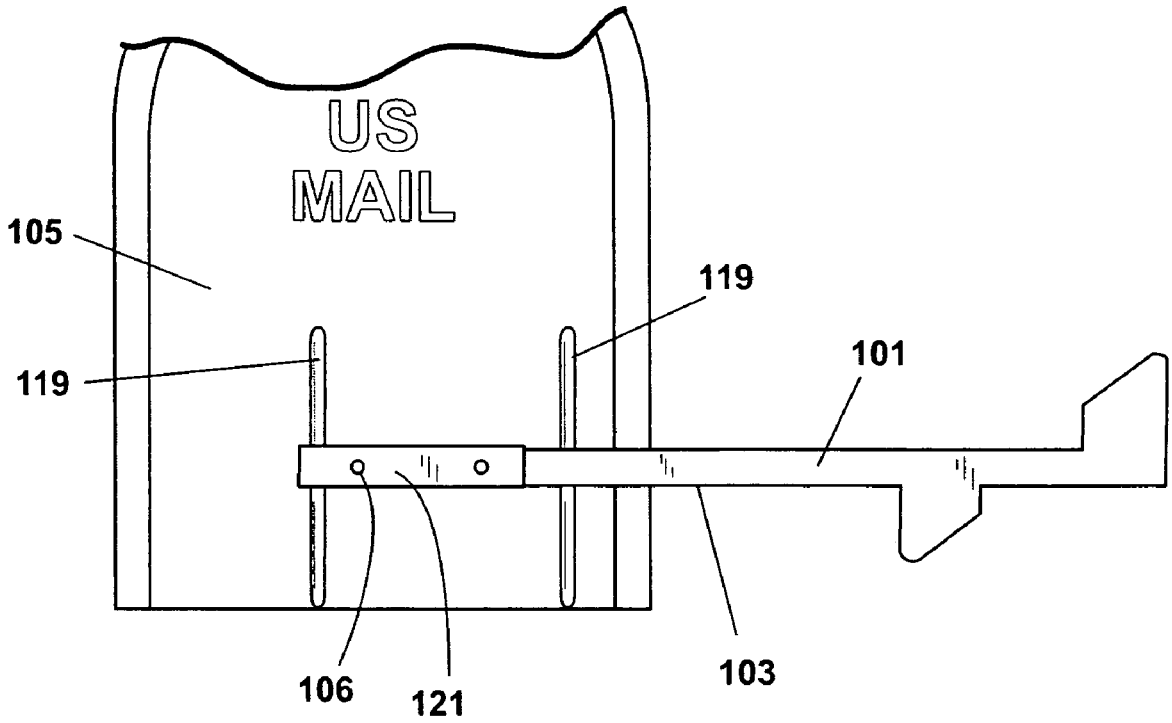
FIG. 4 is an alternative embodiment to the invention shown in FIG. 1 illustrating a side view of a signal holder bracket that is fixedly attached to a mailbox door.

FIG. 4 illustrates a side view of an alternative embodiment to that shown in FIG. 1 where the signal holder bracket 101 is fixedly attached to the mailbox door 105. The signal holder bracket 101 includes a plurality of guides 11 which operate to allow the user to attach the signal holder bracket 101 to the mailbox door 105 in a predetermined location. In operation, the user can position the signal holder bracket 101 either on the left or right side of the mailbox door. The guides 119 provide a reference to position the mounting section 121 of the bracket in the correct location on the surface of the mailbox door 105. If used on a recessed door, the position of the mounting section 121 is critical in order to allow the offset section 103 to operate properly. The guides 119 are attached to the signal holder bracket 101 such that they can be easily removed. Thus, the guides allow the user to quickly attach the mounting section 121 at the proper position eliminating guess work and trial and error methods of attachment. Once positioned, an adhesive (not shown) or other mechanical fastener may be used to securely attach the mounting section 121 at one or more mounting locations 106 to the mailbox door 105. Those skilled in the art will recognize that the mounting locations 106 may be screw holes or slots enabling the user to install the signal holder bracket 101 in the desired position.

Thus, the present invention is a mail delivery indicator for a mailbox with a door that includes a signal holder bracket attached to a mailbox door where a signal ball is attached by a tether to the signal holder bracket for indicating when the mailbox door is opened. The signal holder bracket attaches within a receptacle attached to the mailbox door allowing it to be easily removed.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims. As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article or apparatus.

I claim:

1. A mail delivery indicator assembly comprising:

a mailbox with a door;

a signal holder bracket;

a signal ball attached by a tether to the signal holder bracket for indicating when the mailbox door is opened; and a holder receptacle directly attached to the mailbox door the holder receptacle including an engagement slot which defines a cavity within the holder receptacle which receives an end of the signal holder bracket to removably attach the signal holder bracket to the holder receptacle.

2. The mail delivery indicator assembly according to claim 1, wherein the signal holder bracket includes a ring portion for holding the signal ball indicating that the mailbox door has not been opened.

3. The mail delivery indicator assembly according to claim 1, wherein the signal holder bracket includes a resilient fastener for engaging with a portion of the holder receptacle.

4. The mail delivery indicator assembly according to claim 1, wherein the signal holder bracket includes an offset section for allowing the bracket to be attached to a recessed portion of the mailbox door.

5. The mail delivery indicator assembly according to claim 1, wherein the signal holder bracket includes at least one guard for preventing the signal ball from being inadvertently removed.

6. A signal indicator assembly for indicating mail delivery comprising:

a mailbox with a door;

a signal holder bracket;

a signal ball for indicating when the mailbox door is opened and closed;

a tether line attached to the signal ball for securing the signal ball to the signal holder bracket; and a holder receptacle directly attached to the mailbox door, the holder receptacle including an engagement slot which defines a cavity within the holder receptacle which receives an end of the signal holder bracket to removably attach the signal holder bracket to the holder receptacle;

wherein the signal holder bracket includes an offset section for allowing the bracket to be fastened to a recessed portion of the mailbox door.

7. The signal indicator assembly as in claim 6, the holder receptacle holding the signal holder bracket into a fixed position.

8. The signal indicator assembly as in claim 6, wherein the signal holder bracket includes a fastener portion for fastening the signal holder bracket within the holder receptacle.

9. The signal indicator assembly according to claim 6, wherein the signal holder bracket includes a ring section for holding the signal ball indicating that the mailbox door has not been opened.

10. The signal indicator assembly according to claim 6, wherein the signal holder bracket includes at least one guard for preventing the signal ball from being inadvertently removed.

11. A signal indicator assembly for indicating that mail has been delivered comprising:

a mailbox with a door;

a signal holder bracket having a ring section;

a holder receptacle directly attached to the mailbox door for holding the signal holder bracket into a fixed position;

the holder receptacle including an engagement slot which defines a cavity within the holder receptacle which receives an end of the signal holder bracket to removably attach the signal holder bracket to the holder receptacle;

a signal ball for indicating when the mailbox door is opened and closed;

a tether line attached to the signal ball for securing the signal ball to the signal holder bracket; and wherein the signal holder bracket includes an offset section for allowing the bracket to be fastened to a recessed portion of the mailbox door.

12. The signal indicator assembly as in claim 11, wherein the signal holder bracket includes a resilient fastener for fastening to the holder receptacle.

13. The signal indicator assembly as in claim 11, wherein ring section holds the signal ball into a fixed position.

14. The signal indicator assembly as in claim 11, wherein the signal holder bracket includes at least one guard for preventing the signal ball from being inadvertently removed from the signal holder bracket.

* * * * *